US005212972A

United States Patent [19]

Kincaid et al.

[11] Patent Number: 5,212,972

[45] Date of Patent: May 25, 1993

[54] TAMPER RESISTANT POP-HANDLE LOCK

[75] Inventors: Herbert Kincaid, Libertyville; John Crocco, Wheeling; David Malik, Hickory Hills, all of Ill.

[73] Assignee: The Eastern Company, Wheeling, Ill.

[21] Appl. No.: 889,876

[22] Filed: Jun. 15, 1992

[51] Int. Cl.[5] ..... E05B 13/10

[52] U.S. Cl. ..... 70/208; 70/360; 70/379 R; 70/418

[58] Field of Search ..... 70/208, 360, 369, 379 R, 70/379 A, 380, 416, 418, DIG. 31

[56] References Cited

U.S. PATENT DOCUMENTS

| | | | |
|---|---|---|---|
| 1,903,765 | 4/1933 | Johnson | 70/379 R |
| 2,023,208 | 12/1935 | Olson | 70/360 |
| 2,046,831 | 7/1936 | Lowe | 70/369 |
| 2,275,362 | 3/1942 | Golden et al. | 70/379 R |
| 2,278,044 | 3/1942 | Scanlan | 70/379 R |
| 3,299,678 | 1/1967 | Spencer . | |
| 3,349,585 | 10/1967 | Walters | 70/379 R |
| 3,438,227 | 4/1969 | Wolniak . | |
| 3,834,198 | 9/1974 | Wiczer | 70/208 |
| 4,132,092 | 1/1979 | Steinbach | 70/208 |
| 4,539,828 | 9/1985 | Teleky | 70/369 |
| 4,552,001 | 11/1985 | Roop | 70/208 |
| 4,760,721 | 8/1988 | Steinbach | 70/208 |
| 4,838,055 | 6/1989 | Gallagher | 70/208 |
| 5,038,588 | 8/1991 | Hall | 70/208 |

FOREIGN PATENT DOCUMENTS

| | | | |
|---|---|---|---|
| 2713381 | 9/1977 | Fed. Rep. of Germany | 70/360 |
| 2527255 | 11/1983 | France | 70/360 |

*Primary Examiner*—Lloyd A. Gall

*Attorney, Agent, or Firm*—Wood, Phillips, VanSanten, Hoffman & Ertel

[57] ABSTRACT

A tamper resistant pop-handle lock is disposed in the door of a vending machine or similar closure, and is used to restrict operation of a spring-biased handle which is seated in a recessed housing and is adapted for manually latching and unlatching the door. The lock has a cylindrical barrel and a rotatable key plug mounted within an opening in the barrel. An axially extending eccentric lug at the inner end of the plug is received in a recess formed on a retractable locking bolt, such that rotation of the plug relative to the barrel causes the locking bolt to move through a second opening in the barrel. A locking surface on the lug-receiving recess engages the eccentric lug when the key plug is in a locked position to prevent radial movement of the bolt and extension of the handle. A pair of diametrically opposed integral tabs on the key plug are engageable with corresponding slots formed in the barrel to prevent forcible axial withdrawal of the key plug from the barrel when the key plug is in the locked position.

3 Claims, 2 Drawing Sheets

TAMPER RESISTANT POP-HANDLE LOCK

BACKGROUND OF THE INVENTION

1. Technical Field

The present invention is a key lock for restricting operation of a pop-type handle on a container closure, such as a vending machine door, and more particularly is a pop-handle lock having improved tamper resistance features for defeating the efforts of unauthorized individuals to forcibly access the interior of the container.

2. Background Art

Pop-handle locks are used to secure the door of a vending machine or similar closure and prohibit unauthorized entry into the machine interior. A prior pop-handle lock is described in Spencer U.S. Pat. No. 3,299,678, issued Jan. 24, 1967, and is illustrated in FIG. 1 generally at 10.

The pop-handle lock 10 has a T-shaped housing 12 with openings 14 for receiving screws 16 for attaching the housing 12 to a vending machine door 18. The housing 12 is provided with a draw screw 19 extending therefrom and having a threaded end 20 for engagement with a mating nut 22 positioned in the interior of a vending machine 23, whereby securement of the vending machine door 18 with the vending machine 23 is achieved by threading the end 20 of the draw screw 19 into the nut 22. A T-shaped handle 24 having an axial shank 26 is seated within the housing 12.

A key-operated lock 28 has a retractable bolt 30 which projects through an opening 32 in the handle shank 26 and is received in an opening 34 in the housing 12 to hold the handle in a retracted, inoperable position, as shown in solid lines in FIG. 1. When the bolt 30 is retracted by means of an appropriate key, a biasing spring 36 pops the handle 24 axially outward of the housing 12 into an extended, operable position, as shown in phantom lines in FIG. 1. In the extended position of the handle 24, a notch 38 on the handle 24 engages a pin 40 on the draw screw 19, whereby the handle can be grasped and used to rotate the threaded shaft end 20 into and out of engagement with the nut 22 for respectively opening and closing the vending machine door 18.

Wolniak U.S. Pat. No. 3,438,227, issued Apr. 15, 1969, describes the manner in which the retractable bolt in a prior pop-handle lock is actuated.

Referring to the sectional view shown in FIG. 2, Wolniak '227 shows a key lock having a rotatable plug 42 disposed in a cylindrical lock barrel 44. A spring biased retractable bolt 46 extends radially through aligned openings in the lock barrel 44 and an axially movable handle 48. A housing 50 fixed to a closure 51 has a notch for receiving the bolt 46 when the key plug is in a locked position. The bolt 46 has a recess 52 for receiving a pin 54 which projects from the end of the key plug 42. A cam surface 53 on the recess 52 contacts the pin 54 when the key plug 42 is rotated to alternatively extend and retract the bolt 46 into and out of engagement, respectively, with the fixed housing 50.

Thieves have developed techniques for defeating the security offered by the prior pop-handle locks.

One technique which is used is that a hole is drilled through the lock or a portion of the door which surrounds the lock, and a stiff wire is inserted through the hole to engage the bolt and retract the bolt out of engagement with the T-handle and housing. The key lock and handle then are popped out of the housing by the biasing spring and the handle is used to open the vending machine door.

Another method in which existing pop-handle lock assemblies have been defeated is by driving a screw into the keyway on the rotatable key plug. The key plug then is forcibly extracted from the lock by prying the screw and attached lock components out of the door. With the key plug extracted, the bolt can be manually retracted to extend the handle and open the door.

SUMMARY OF THE INVENTION

The locking bolt of a tamper resistant pop-handle lock has a lug-receiving recess with a locking surface for engaging an axially extending lug on a key-plug to prevent the bolt from being manually retracted without rotating the key plug. The recess has a pocket adjacent the locking surface which loosely receives the bolt when the key plug is not in the locked position, and is related to the locking surface such that the bolt is radially movable independent of key plug rotation when the key plug is rotated at least approximately forty-five degrees from the locked position.

The key plug has a pair of diametrically opposed integral tabs near the inner end of the plug for engaging complementary radial slots formed in the barrel. The slots are diametrically opposed in the barrel opening and are aligned with the tabs when the key plug is in the locked position. Receipt of the tabs with a respective one of the slots prevents withdrawal of the key plug from the barrel when an axial force is applied to the key plug.

BRIEF DESCRIPTION OF THE DRAWINGS

Other features and advantages of the invention will be apparent from the following detailed description taken in connection with the accompanying drawings wherein.

DETAILED DESCRIPTION OF THE INVENTION

Figure 1:
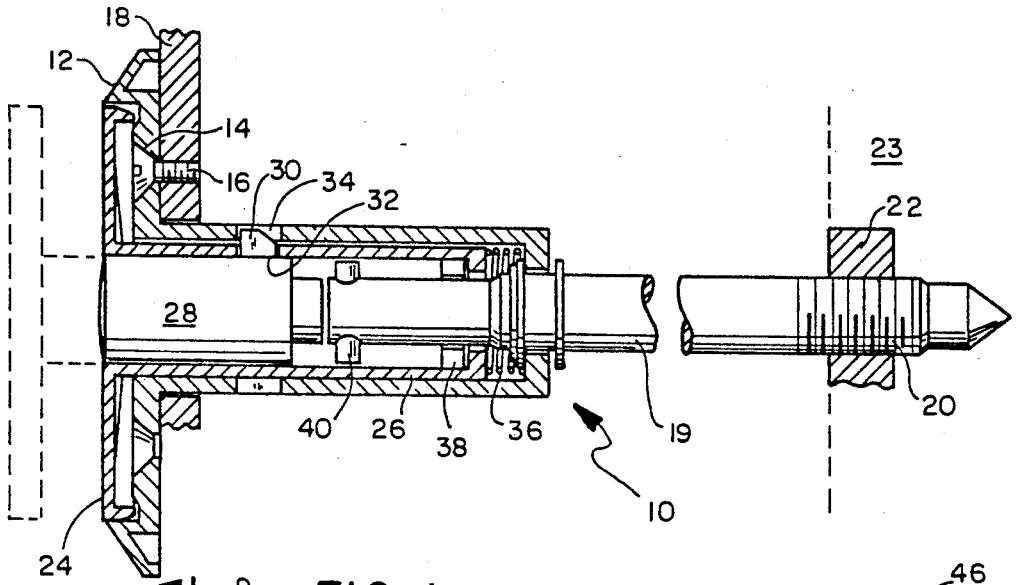
FIG. 1 (PRIOR ART)
FIG. 1 is a side view of a prior art pop-handle lock assembly for locking and unlocking a vending machine door.
Figure 3:
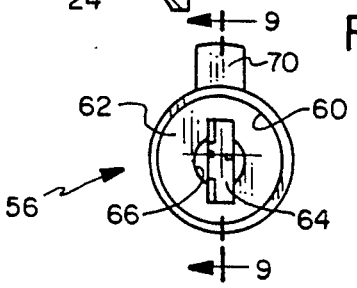
FIG. 3 is an end view of the present pop-handle key lock in a locked position.
Figure 2:
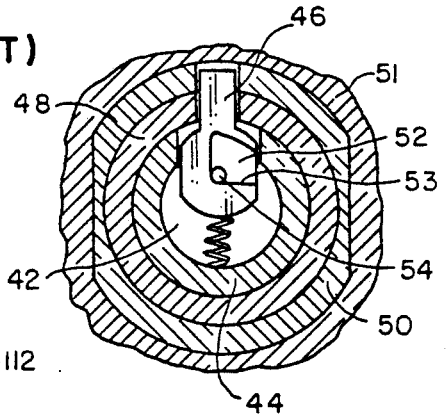
FIG. 2 (PRIOR ART)
FIG. 2 is a sectional view through the lock barrel of prior art key lock of the type used in the pop-handle lock assembly illustrated in FIG. 1.
Figure 4:
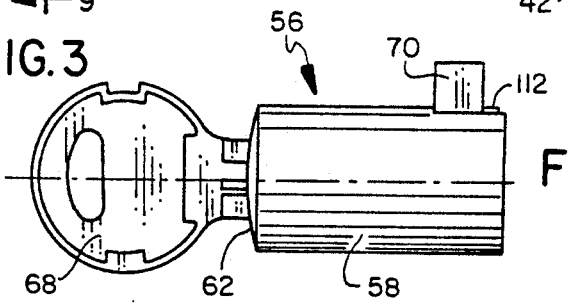
FIG. 4 is a side of the key lock illustrated in FIG. 3.

FIGS. 3 and 4 illustrate a key lock 56 for a pop-handle assembly as discussed above with respect to FIG. 1. That is, in a manner analogous to locking mechanism 28 of the prior art, the key lock 56 is used for restricting operation of an axial movable pop-handle 24 by maintaining the handle in a retracted, inoperable position.

The key lock 56 has a cylindrical lock barrel 58 with an axial opening 60 for receiving a rotatable key plug 62. The key plug 62 carries a number of retractable tumblers 64 which together define a keyway 66. Insertion of an appropriate key 68 into the keyway 66 retracts the tumblers 64 and permits rotation of the key plug 62 relative to the lock barrel 58 to actuate a bolt 70. As will be shown below, the bolt 70 is moved radially through the barrel 58 between a retracted, unlatched position (see FIG. 11), and an extended, latched position (FIGS. 4, 14) when the key plug 62 is rotated between a locked position and an unlocked position, respectively. The bolt 70 is received in the opening 34 on the housing 12 when the bolt 70 is in the extended position. Engagement of the bolt 70 with the opening 34 prevents the pop-handle 24 from moving to an extended position and thereby prohibits the pop-handle 24 from being operated to open the vending machine door 18.

Figure 5:
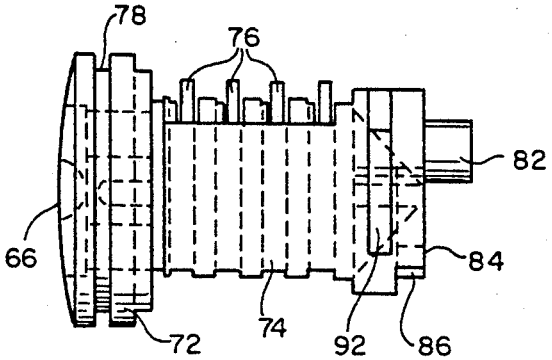
FIG. 5 is a side elevational view of the key plug illustrated in FIGS. 3 and 4.
Figure 6:
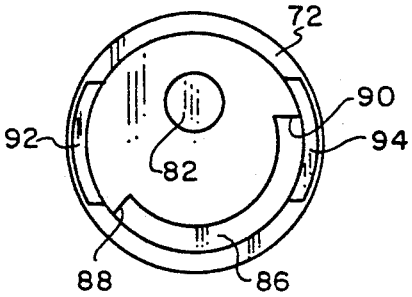
FIG. 6 is an end elevational view of the key plug looking from the right of FIG. 5.

The key plug 62 is illustrated in FIGS. 5 and 6 and has an enlarged head 72 and an elongated shank 74. The shank 74 has a number of axially spaced radial tumblerways 76 for slidably receiving tumblers 64, and an annular groove 78 extends around the periphery of the enlarged head 72 for seating a resilient retainer ring 80. An eccentric axial lug 82 projects from an end face 84 of the key plug 62. The end face 84 has an arcuate groove 86 which extends circumferentially between stops 88 and 90 for limiting rotation of the key plug 62 in a manner to be described below. A pair of diametrically opposed radial tabs 92 and 94 are formed integrally with the key plug 62 and span a diameter substantially equal to the enlarged head 72. Each tab has an angular extent of approximately 60 degrees.

Figure 7:
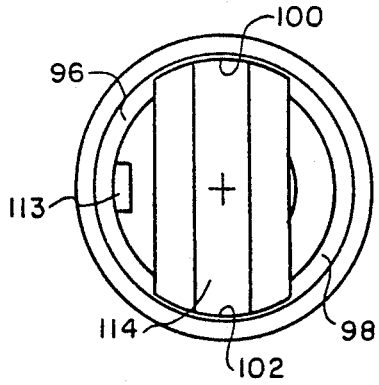
FIG. 7 is an end elevational view of the lock barrel looking from the left of FIG. 8.
Figure 8:
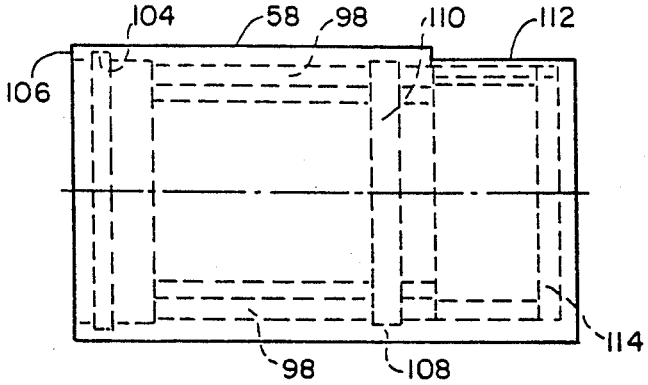
FIG. 8 is a side elevational view of the lock barrel illustrated in FIGS. 3 and 4.

FIGS. 7 and 8 illustrate lock barrel 58. Symmetric arcuate sidewalls 96 and 98 are provided in the lock barrel interior and extend longitudinally through the axial opening 60 to define diametrically opposed axial slots 100 and 102. Slots 100 and 102 receive tumblers 64 when the key plug 62 is in a locked position and the key is removed. That is, when the tumblers 64 are radially extended into the slots 100 or 102, rotation of the key plug 62 relative to the lock barrel 58 is prevented by interference between the tumblers and the sidewalls 96 and 98. An annular groove 104 is provided in the interior of lock barrel 58 near the open end 106 thereof for seating the resilient retainer ring 80 and capturing the key plug 62 in the barrel 58.

As shown in FIG. 8, the symmetric arcuate sidewalls 96 and 98 extend longitudinally through the lock barrel 58 and are interrupted by a pair of arcuate peripheral grooves 108 which have an angular extent of the sidewalls 96 and 98. A radial opening 112 is provided in the lock barrel 58 for slidably receiving the retractable locking bolt 70, and a diametric groove 114 in the lock barrel interior and is aligned with the slots 100 and 102. A tooth 113 is formed in the housing and is received in the arcuate groove 86 on the key plug 62 to limit rotation thereof.

Figure 9:
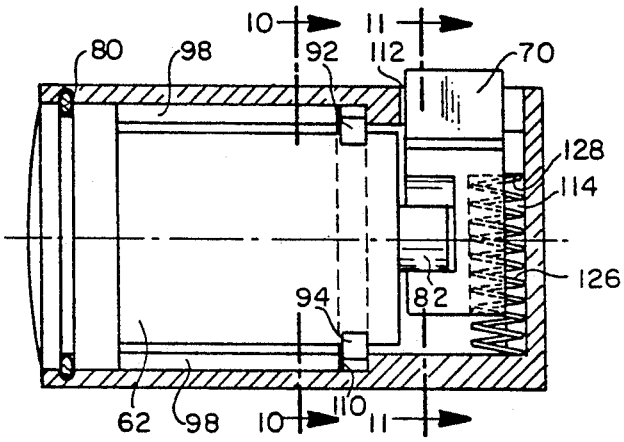
FIG. 9 is similar to the section taken along line 9—9 of FIG. 3 with the key lock illustrated in an unlocked position.
Figure 10:
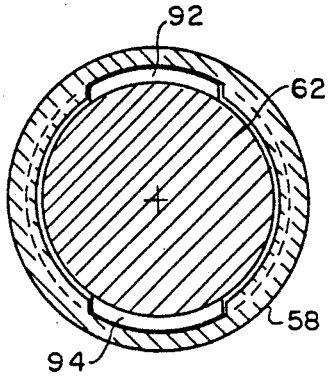
FIG. 10 is a transverse section taken along line 10—10 of FIG. 9.
Figure 11:
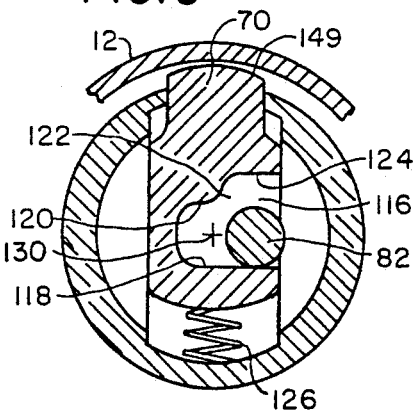
FIG. 11 is a transverse section taken along line 11—11 of FIG. 10 with a portion of the lock housing shown.
Figure 12:
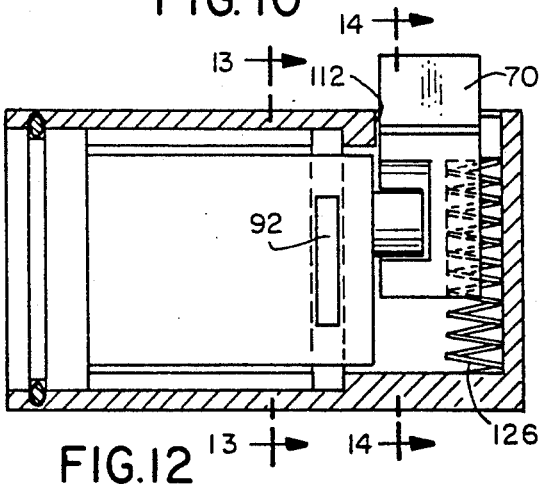
FIG. 12 is a transverse section taken along line 12—12 of FIG. 3.
Figure 13:
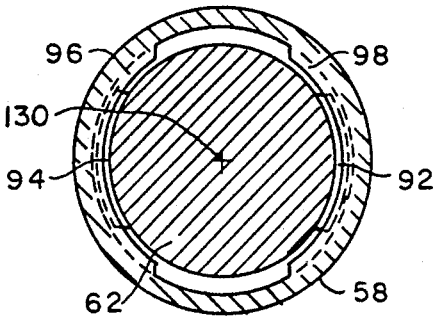
FIG. 13 is a transverse section taken along line 13—13 of FIG. 12.
Figure 14:
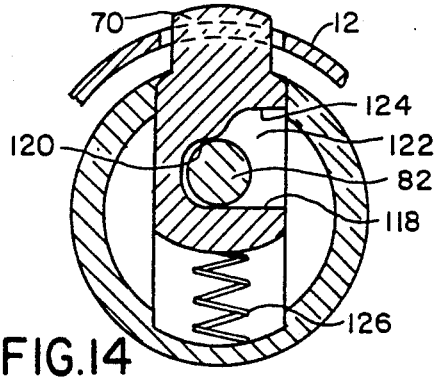
FIG. 14 is a transverse section taken along line 14—14 of FIG. 12 with a portion of the lock housing shown.

The manner in which the above-discussed components interact can be understood with reference to FIGS. 9-11, wherein the key lock 56 is shown in an unlocked position and the bolt 70 is in an unlatched position, and further in FIGS. 12-14, wherein the key lock 56 is shown in a locked position and the bolt 70 is in a latched position.

Referring first to FIGS. 11 and 14, the bolt 70 has a recess 116 for receiving the lug 82. The recess has a transverse cam surface 118 and a locking surface 120 which extends in parallel spaced relationship to the cam surface 118. The distance between the locking surface 120 and the cam surface 118 is substantially equal to the diameter of the lug 82, such that when the lug 82 is rotated into engagement with the locking surface 120 (FIG. 14) the lug 82 is captured by the cam surface 118 to prevent the bolt 70 from moving independently of the key plug 62.

The recess 116 has a pocket 122 adjacent the locking surface 120 for loosely receiving the lug 82 when the key plug 62 is not in the locked position. As shown in FIG. 11, the pocket 122 has a surface 124 which is spaced from the transverse cam surface 118 by a distance which is greater than the diameter of the lug 82, so that when the lug 82 is disengaged from the locking surface 120 the bolt 70 is free to move through the radial opening 112 independent of rotation of the key plug 62. The relationship between the locking surface 120 and the pocket 122 of the recess 116 is such that the bolt 70 is freed for independent radial movement through the opening 112 when the key plug 62 is rotated at least approximately 45° from the locked position.

To unlock the lock 56, the key 68 is inserted into the keyway 66 to retract the tumblers 64 into the lock barrel 58 and permit rotation of the key plug 62. When the key plug 62 is rotated toward the unlocked position shown in FIG. 11, the axial lug 82 moves along the cam surface 118 of the recess 116 and applies a force to retract the bolt 70 into the housing 12.

When the key plug 62 is rotated a distance sufficient to draw the outer end 149 of the bolt 70 radially within the housing 12, the pop-handle 24 is urged axially out of the housing 12 by the coil spring 36 and into the extended position wherein the handle 24 is operable to open the vending machine door 18. In the extended position of the pop-handle 24, the bolt 70 is held in the retracted position by engagement of the bolt end 149 with the inner wall of the housing 12. Rotation of the key plug 62 from the locked position to the unlocked position is limited by interference between the tooth 113 on the lock barrel 58 and the stops 88 and 90 on the groove 86.

To lock the key lock 56, the pop-handle 24 is urged axially into the housing 12. A compressed coil spring 126 seated in the diametric groove 114 in the lock barrel 58 applies a radial biasing force to a shoulder 128 on the bolt 70. When the radial opening 112 on the lock barrel 58 is aligned with the radial opening 34 in the housing 12, the coil spring 126 forces the bolt 70 radially outward through the openings 112 and 34 to hold the handle 24 in the retracted, inoperable position.

As the bolt 70 moves radially outward through the opening 112, the transverse cam surface 118 on the recess 116 engages the eccentric lug 82 and rotates the key plug 62 about a center axis of rotation 130 toward the locked position. When the key plug 62 reaches the locked position, the key 68 is withdrawn from the keyway 66 and the tumblers 64 are biased into engagement with the axial slots 100 and 102 to prevent rotation of the key plug 62 relative to the barrel 58.

As described above, and as illustrated in FIG. 14, when the key plug 62 is in the locked position, the lug 82 is captured between the locking surface 120 and the cam surface 118 of the recess 116 to prevent radial movement of the bolt 70. Because the lug 82 must be disengaged from the locking surface 120 before the bolt 70 can be axially retracted, the bolt 70 therefore cannot be retracted without rotating the key plug 62. As a result, the bolt 70 cannot be manually retracted by a thief, as by drilling a hole through the door 18 and inserting a stiff wire to engage the bolt 70.

An additional tamper proof feature is provided by the diametrically opposed radial tabs 92 and 94 on the key plug 62. When the key plug 62 is in the unlocked position, the tabs 92 and 94 are aligned with the tumbler-receiving slots 100 and 102 in the lock barrel 58. When the key plug 62 is rotated to the locked position, the radial tabs 92 and 94 are received in the locking groove 110 and are captured behind the arcuate sidewalls 96 and 98 (see FIG. 13). Reception of the tabs 92 and 94 in the locking groove prevents forcible withdrawal of the key plug 62 from the lock barrel 58 when the key plug 62 is in the locked position, such as by the application of an axial force to a screw which is embedded in the keyway 66.

We claim:

1. A tamper resistant pop-handle lock having a housing for attachment to a closure element, a handle disposed in the housing and axially movable between an extended position wherein the handle is operable for opening the closure element and a retracted position wherein the handle is inoperable, a spring interposed between the housing and the handle for biasing the handle toward the extended position, a lock barrel disposed in the handle and having an axial opening, a plug rotatable within the barrel opening about a center axis of the plug between a locked position and an unlocked position, the plug having a key-retractable tumbler, said tumbler being extendable into engagement with a slot on the barrel to prevent rotation of the plug relative to the barrel with the plug in the locked position, the plug also having an eccentric axial lug, a bolt movable through a radial opening in the barrel and engageable with the housing for holding the handle in the retracted position, said lug being aligned with the radial opening and said center axis of the plug when the plug is in the locked position, the bolt having a recess for receiving the axial lug and including a cam surface engaged by the axial lug for moving the bolt radially inward through the opening in the barrel when the plug is rotated toward the unlocked position, a second spring interposed between the bolt and the barrel for moving the bolt radially outward through the opening in the barrel when the plug is rotated toward the locked position, the improvement comprising a locking surface on the lug-receiving recess for engagement with the lug, preventing radial movement of the bolt when the plug is in the locked position, the lug-receiving recess having a pocket adjacent the locking surface for loosely receiving the lug when the plug is not in the locked position to allow radial movement of the bolt without rotating the key plug.

2. The lock of claim 1 wherein the locking surface and the cam surface are related such that the bolt is movable through the radial opening in the barrel when the plug is rotated at least approximately forty-five degrees from the locked position.

3. The lock of claim 1 in which the locking surface and the cam surface are substantially parallel spaced apart surfaces, the lug having a width substantially equal to the distance between the locking surface and the cam surface, the pocket having a surface spaced from said cam surface a distance greater than the width of the lug.

* * * * *